US006986271B2

(12) United States Patent
Kim et al.

(10) Patent No.: US 6,986,271 B2
(45) Date of Patent: Jan. 17, 2006

(54) WASHING MACHINE

(75) Inventors: Hyung-Kyoon Kim, Suwon (KR); Seung-Ho Lee, Anyang (KR); Sang-Yeon Pyo, Suwon (KR); Chan-Woo Park, Anyang (KR); Myung-Gyu Lee, Suwon (KR); Seon-Woo Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 329 days.

(21) Appl. No.: 10/197,336

(22) Filed: Jul. 18, 2002

(65) Prior Publication Data

US 2003/0154750 A1 Aug. 21, 2003

(30) Foreign Application Priority Data

Feb. 15, 2002 (KR) ..... 2002-8244

(51) Int. Cl.
*D06F 37/40* (2006.01)

(52) U.S. Cl. ..... 68/23.6; 68/131

(58) Field of Classification Search ..... 68/131, 68/23.6; 8/158, 159
See application file for complete search history.

(56) References Cited

U.S. PATENT DOCUMENTS 2,145,453 A * 1/1939 Miller ..... 68/28
2,145,454 A * 1/1939 Miller ..... 68/28
2,509,264 A * 5/1950 Cox ..... 73/863.24
2,695,510 A * 11/1954 Clark ..... 68/23.6
2,831,333 A * 4/1958 Smith ..... 68/131
2,902,851 A * 9/1959 Fields ..... 68/131
2,902,852 A * 9/1959 Fields ..... 68/131
2,921,460 A * 1/1960 Aberle ..... 68/131
2,931,201 A * 4/1960 Hubbard ..... 68/131
2,948,128 A * 8/1960 Smith ..... 464/137
3,412,621 A * 11/1968 Jacobs ..... 74/721
5,460,018 A * 10/1995 Werner et al. ..... 68/23.6
5,946,949 A 9/1999 Park et al.
6,115,863 A * 9/2000 Mason et al. ..... 8/159
6,227,013 B1 * 5/2001 Wyatt-Smith ..... 68/134

OTHER PUBLICATIONS

U.S. Appl. No. 10/197,332, Kim Hyung–Kyoon et al., filed Jul. 18, 2002.
U.S. Appl. No. 10/216,238, Pyo Sang–Yeon et al., filed Aug. 12, 2002.
U.S. Appl. No. 10/216,430, Kim Hyun–Sook et al., filed Aug. 12, 2002.

* cited by examiner

*Primary Examiner*—Frankie L. Stinson
(74) *Attorney, Agent, or Firm*—Staas & Halsey LLP

(57) ABSTRACT

A washing machine having a wobbling device. The wobbling device causes a wobbling action of a washboard without rotating the washboard during a washing mode operation, thus effectively washing the clothes. This wobbling device includes a vertical rotary shaft rotated by a washing shaft, and an inclined rotary shaft arranged above the vertical rotary shaft. A first rotary unit couples the inclined rotary shaft to the vertical rotary shaft, thus rotating the two shafts at the same time. An upper surface of the first rotary unit forms a first sloping surface inclined at an angle of inclination. A second rotary unit rotatably receives the inclined rotary shaft therein, and is provided at its lower surface with a second sloping surface corresponding to the first sloping surface of the first rotary unit. A plurality of pins control the relative positions of the first and second sloping surfaces, thus changing the position of the upper surface of the second rotary unit between a horizontal position and an inclined position. A washboard is arranged outside the second rotary unit, and is changed between a wobbling position and a leveled position in accordance with an operation of the pins.

42 Claims, 8 Drawing Sheets

WASHING MACHINE

CROSS-REFERENCE TO RELATED APPLICATIONS

This application claims the benefit of Korean Patent Application No. 2002-8244 filed on Feb. 15, 2002, in the Korean Industrial Property Office, the disclosure of which is incorporated herein by reference.

BACKGROUND OF THE INVENTION

1. Field of the Invention

The present invention relates to washing machines and, more particularly, to a washing machine having a wobbling device which causes a wobbling action of a washboard installed at an inner bottom surface of a spin-drying tub, so as to effectively wash clothes.

2. Description of the Related Art

Generally, washing machines are used to wash clothes by rotating a cylindrical rotary tub containing the clothes and wash water therein. Such washing machines have been typically classified into two types, that is, drum type washing machines and vertical shaft type washing machines. In the drum type washing machines, a rotary tub is horizontally set in a cabinet and is rotated around a horizontal axis of the cabinet in opposite directions. These actions repeatedly move the clothes seated on an inner lower surface of the rotary tub upward, and allow the clothes to be dropped from the top to the bottom inside of the rotary tub, due to gravity, to wash the clothes. The vertical shaft type washing machines are designed such that a rotary tub with a pulsator is vertically set in a cabinet, and is rotated around a vertical axis of the cabinet in opposite directions. The forced water currents generated by the pulsator wash the clothes placed inside the rotary tub of the vertical shaft type washing machines.

The present invention relates to vertical shaft type washing machines. FIG. 1 shows the construction of a conventional vertical shaft type washing machine. The conventional vertical shaft type washing machine comprises a cabinet 1 which forms the external appearance of the washing machine. A tub assembly, consisting of two tubs, is set in the cabinet 1. That is, a washing tub 2 is vertically set in the cabinet 1 and contains wash water therein, while a spin-drying tub 3 is rotatably and concentrically set in the washing tub 2. The spin-drying tub 3 is perforated in its sidewall to have spin-drying perforations 3*c*. A pulsator 4 is installed on the bottom of the spin-drying tub 3, and generates wash water currents inside the spin-drying tub 3. The vertical shaft type washing machine also has a drive motor 5 and a power transmission unit 6, which are installed in a space between the bottom of the washing tub 2 and the bottom of the cabinet 1. The drive motor 5 is a reversible motor which generates a reversible rotating force. The power transmission unit 6 transmits the reversible rotating force from the drive motor 5 to the tub assembly, thus rotating the spin-drying tub 3 and the pulsator 4.

The top of the cabinet 1 is open to allow a user to place or remove the clothes from the spin-drying tub 3. A door 7 is hinged to an edge of the open top of the cabinet 1. The user is thus allowed to open the top of the cabinet 1 to place or remove the clothes from the spin-drying tub 3. A drain hose 8 extends from the bottom of the washing tub 2 to the outside of the cabinet 1, and discharges the wash water from the washing tub 2 to the outside after a washing mode operation.

The spin-drying tub 3 comprises a bottom part 3*a*, with a spin-drying shaft holder 9 exteriorly mounted to the bottom part 3*a*. The power transmission unit 6 has two shafts 6*a* and 6*b*. That is, the spin-drying shaft 6*a* of the power transmission unit 6 is coupled to the bottom of the spin-drying tub 3 by the spin-drying shaft holder 9, while the washing shaft 6*b* of the power transmission unit 6 passes through the interior of the spin-drying shaft 6*a* so as to be coupled to the pulsator 4. The pulsator 4 is installed on the bottom of the spin-drying tub 3. The washing shaft 6*b* rotates the pulsator 4 during the washing mode operation.

The above vertical shaft type washing machine with the pulsator 4 is operated as follows. When the washing machine is turned on, after placing clothes into the spin-drying tub 3, water is primarily fed into the washing tub 2. The reversible drive motor 5 is rotated to generate a rotating force, which is transmitted to the pulsator 4 through the washing shaft 6*b* of the power transmission unit 6. Accordingly, the pulsator 4 is rotated in opposite directions. Such a reversible rotating action of the pulsator 4 generates forced wash water currents inside the spin-drying tub 3, and the clothes are washed by being forcibly moved along with the forced wash water currents while coming into frictional contact with both an internal surface of the spin-drying tub 3 and with each other.

When such a washing mode operation is completed, after elapse of a predetermined period of time, the wash water is drained from the washing tub 2 to the outside of the washing machine through the drain hose 8 before a rinsing mode operation is started. After the rinsing mode operation, a high speed rotating force of the reversible drive motor 5 is transmitted to the spin-drying tub 3 through the spin-drying shaft 6*a* of the power transmission unit 6, thus rotating the spin-drying tub 3 in a direction at a high speed to spin-dry the clothes. When a spin-drying mode operation is completed, the washing machine finishes the operation of washing the clothes.

In the washing mode operation of the conventional vertical shaft type washing machine, the pulsator 4 is alternately rotated in opposite directions to generate the forced wash water currents in the spin-drying tub 3, thereby washing the clothes by the forced wash water currents. The clothes are thus forcibly moved in the opposite directions, and are twisted and tangled up to each other. Therefore, the conventional vertical shaft type washing machine abrades and damages the clothes during a washing operation, and forces a user to untwist and untangle the clothes after the washing operation. Accordingly, such a vertical shaft type washing machine is inconvenient to use and promotes rapid wear and tear of the clothes.

In addition, to generate the forced wash water currents, the pulsator 4 must be reversibly rotated in short time intervals during the washing mode operation. Thus, the reversible drive motor 5 consumes a lot of electric power while being repeatedly rotated in the opposite directions at such short time intervals. Such an alternating rotation of the reversible drive motor 5 also reduces the expected life span of the reversible drive motor 5.

Furthermore, the conventional vertical shaft type washing machine with the pulsator 4 is designed such that a desired washing effect is enhanced by forcibly rotating the clothes in the opposite directions using the forced water currents. Accordingly, such a design requires an excessive amount of water in the washing tub 2 during the washing mode operation. A large volume of the water required for the washing operation, in turn, requires an additional use of detergent, inevitably causing a greater harm of the environment. Recent trends show that consumers are making a conscious decision to save water and restrict the use of household chemicals to preserve the environment. Therefore, there is a need to solve the above-mentioned problems experienced by the conventional vertical shaft type washing machines.

SUMMARY OF THE INVENTION

Accordingly, it is an object of the present invention to provide a washing machine having a wobbling device which causes an upward and downward wobbling action of a washboard without rotating the washboard during a washing mode operation, thus effectively washing the clothes.

Additional objects and advantages of the invention will be set forth in part in the description which follows and, in part, will be obvious from the description, or may be learned by practice of the invention.

To achieve the above and other objects of the present invention, there is provided a washing machine comprising a washing tub for containing wash water therein, a spin-drying tub rotatably set in the washing tub for containing clothes therein, a spin-drying shaft which rotates the spin-drying tub, a washing shaft which axially passes through and projects from a top end of the spin-drying shaft, and a wobbling device which is coupled to a projected end of the washing shaft and causes the clothes to wobble upward and downward to wash the clothes.

The wobbling device comprises an inclined rotary shaft which is arranged in an axial direction of the washing shaft at an angle of inclination, a first rotary unit which rotates in response to torque of the washing shaft, having a first sloping surface which is inclined in a radial direction of the washing shaft at a set angle of inclination, a second rotary unit which is arranged to be rotated relative to the first rotary unit, having a second sloping surface which corresponds to the first sloping surface of the first rotary unit, and a hole which is axially formed in the second rotary unit and rotatably receives the inclined rotary shaft therein, an actuating pin which is installed to and rotates along with one of the washing shaft, the first rotary unit and the inclined rotary shaft, a wobbling pin and a leveling pin which are provided on the second rotary unit at spaced positions, and a washboard which is arranged at an inner lower portion of the spin-drying tub, and wobbles in response to rotating of the actuating pin in contact with the wobbling pin and being leveled in response to rotating of the actuating pin in contact with the leveling pin.

The inclined rotary shaft passes through the hole of the second rotary unit so as to be projected at an upper end thereof from an upper end of the second rotary unit. The actuating pin is transversely mounted to the upper end of the inclined rotary shaft, and the leveling and wobbling pins are arranged on an upper surface of the second rotary unit at positions angularly spaced apart from each other at an angle of, for example, about 180°.

The first inclined surface is formed at an upper end of the first rotary unit, and the second inclined surface is formed at a lower end of the second rotary unit. Accordingly, the upper surface of the secondary rotary unit is leveled to have the washboard in a leveled position in response to the actuating pin being rotated in a first direction while coming into contact with the leveling pin, wherein an upper part of the first sloping surface meets an upper part of the second sloping surface. On the other hand, the upper surface of the secondary rotary unit is inclined to have the washboard in a wobbling position in response to the actuating pin being rotated in a second direction while coming into contact with the wobbling pin, wherein a lower part of the first sloping surface meets the upper part of the second sloping surface.

The washing machine may further comprise a vertical rotary shaft which is arranged between the washing shaft and the first rotary unit, and transmits the torque of the washing shaft to the first rotary unit, wherein the vertical rotary shaft is coupled at a upper end thereof to a lower end of the first rotary unit, and coupled at a lower end thereof to an upper end of the washing shaft.

BRIEF DESCRIPTION OF THE DRAWINGS

These and other objects and advantages of the present invention will become apparent and more readily appreciated from the following description of the embodiments, taken in conjunction with the accompanying drawings of which:

FIGS. 2A and 2B are sectional views showing the construction of a vertical shaft type washing machine having a wobbling device according to an embodiment of the present invention, in which FIG. 2A shows the washing machine with the wobbling device placed in its leveling position for performing a spin-drying mode operation, and FIG. 2B shows the washing machine with the wobbling device placed in its wobbling position for performing a washing mode operation;

DETAILED DESCRIPTION OF THE PREFERRED EMBODIMENTS

Figure 1:
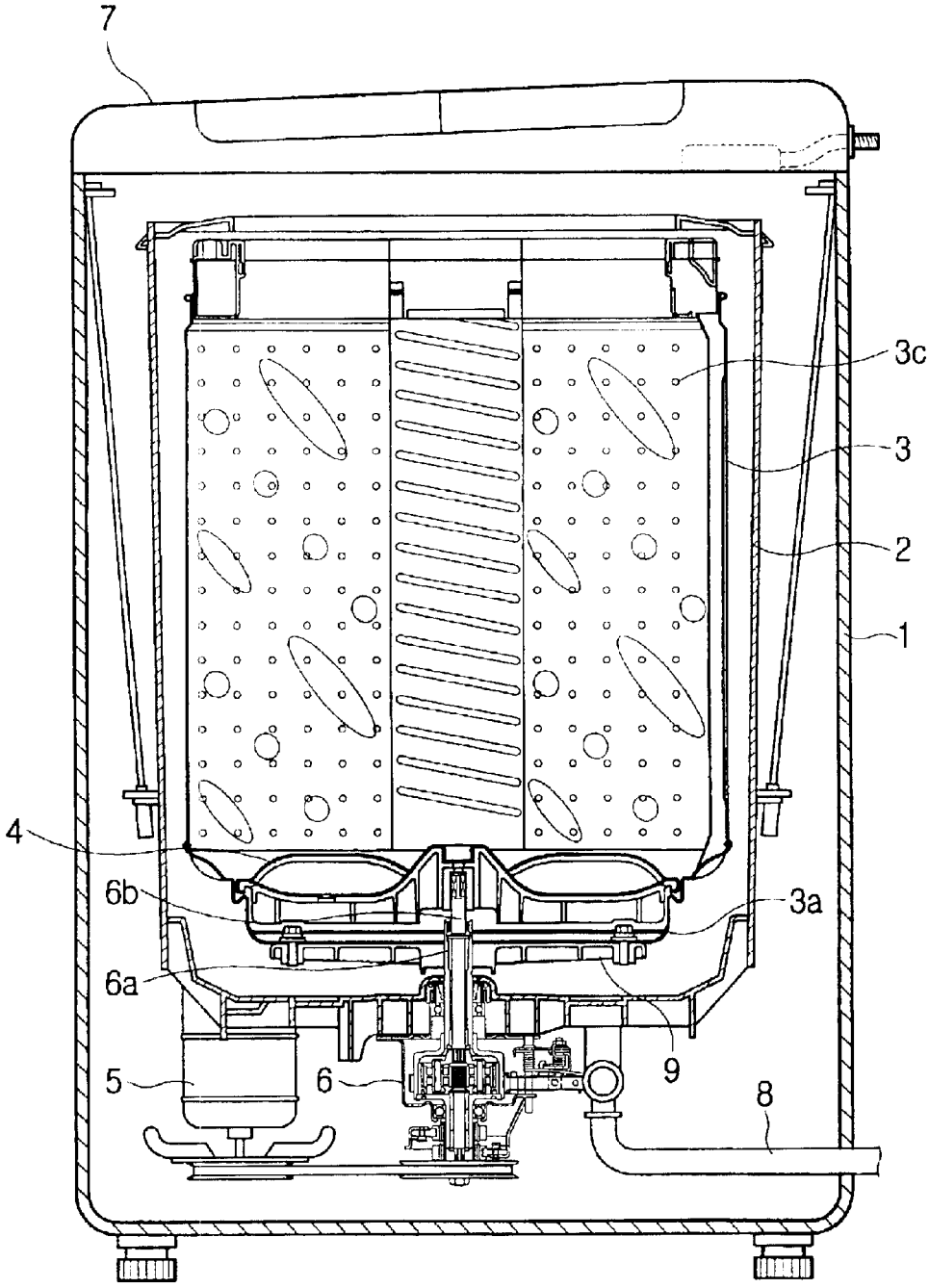
FIG. 1 (PRIOR ART)
FIG. 1 is a sectional view showing the construction of a conventional vertical shaft type washing machine with a pulsator.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2A:
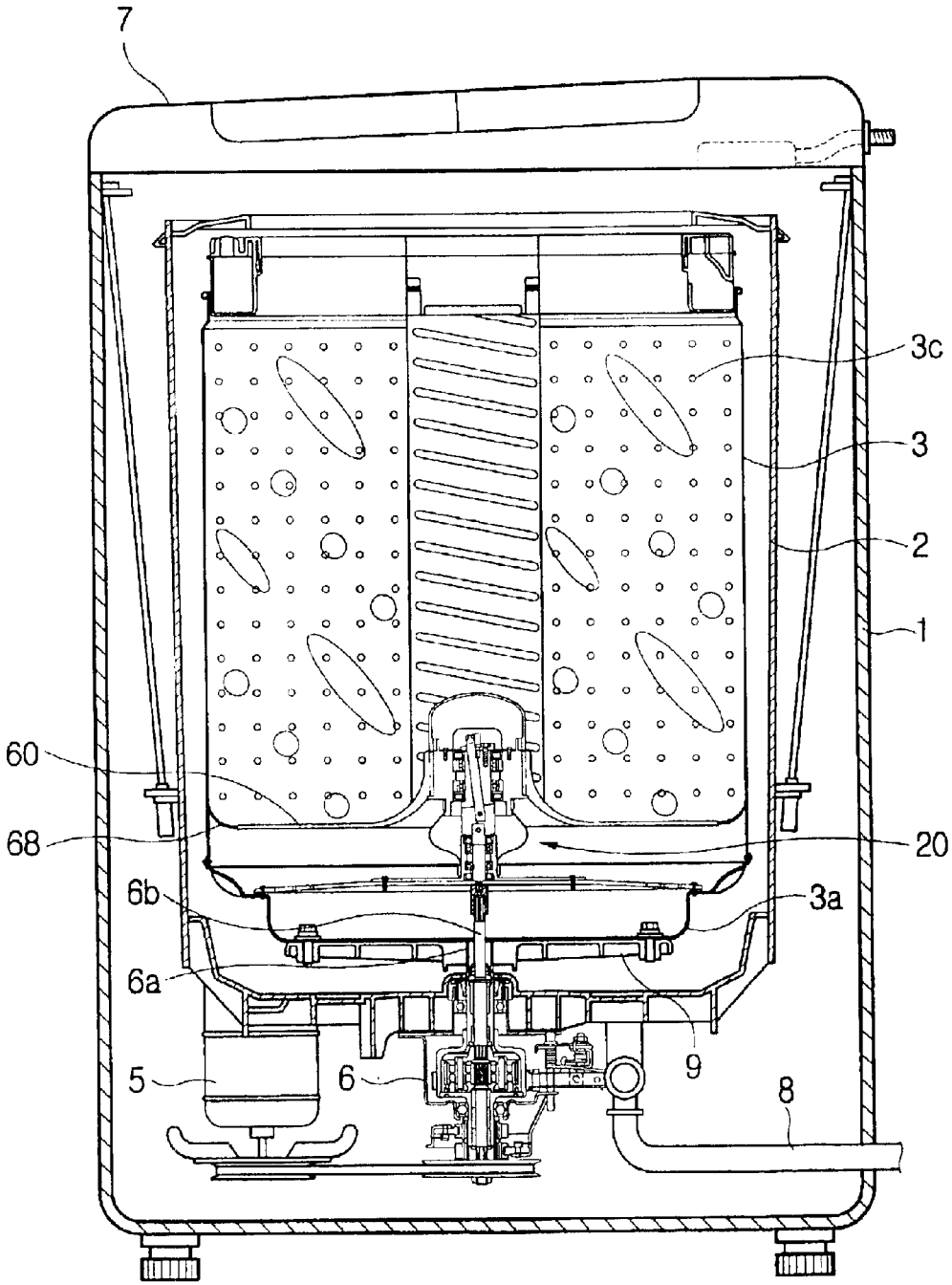
Figure 2B:
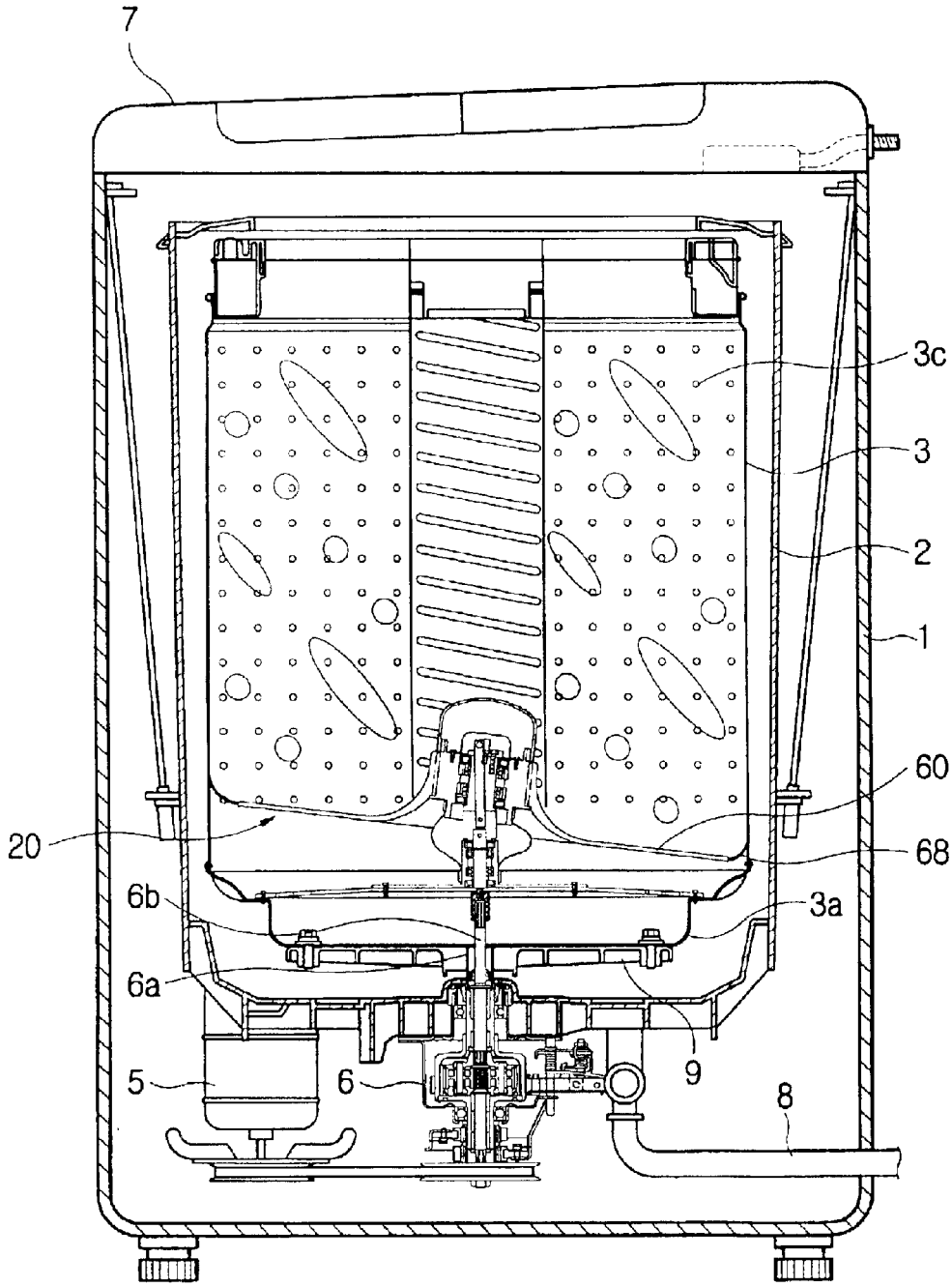

FIGS. 2A and 2B show the construction of a vertical shaft type washing machine having a wobbling device according to an embodiment of the present invention. Specifically, FIG. 2A shows the wobbling device placed in its leveling position for performing a spin-drying mode operation, while FIG. 2B shows the wobbling device placed in its wobbling position for performing a washing mode operation. The technical term "wobbling position" is defined as a position where the wobbling device arranges a washboard in an inclined position so as to cause an upward and downward wobbling action of the washboard. The technical term "leveling position" is defined as a position where the wobbling device arranges the washboard in a horizontal position so as to hold the washboard without allowing such a wobbling action of the washboard.

As shown in FIGS. 2A and 2B, the vertical shaft type washing machine ("washing machine") of the present invention comprises a tub assembly having two tubs set in a cabinet 1. That is, a washing tub 2 is vertically set in the cabinet 1 for containing wash water therein, while a spin-drying tub 3 is rotatably and concentrically set in the washing tub 2. The spin-drying tub 3 is perforated on its sidewall to have a plurality of spin-drying perforations 3*c*. In addition, both a drive motor 5 and a power transmission unit 6 are installed in a space between the bottom of the washing tub 2 and the bottom of the cabinet 1. The washing machine further comprises a wobbling device 20 installed on the bottom of the spin-drying tub 3.

A spin-drying shaft holder 9 is mounted to an exterior portion of a bottom part 3*a* of the spin-drying tub 3. The bottom part 3*a* couples a spin-drying shaft 6*a* of the power transmission unit 6 to the spin-drying tub 3. The spin-drying shaft 6*a* rotates the spin-drying tub 3 during a spin-drying mode operation. A washing shaft 6*b* of the power transmission unit 6 passes through the interior of the spin-drying shaft 6*a,* and is projected upward from a top end of the spin-drying shaft 6*a* so as to be coupled to a wobbling device 20.

The wobbling device 20 is provided inside the cabinet 1 at the bottom of the spin-drying tub 3. During a washing mode operation of the washing machine, the wobbling device 20 is selectively placed at the wobbling position as shown in FIG. 2B, so as to cause an upward and downward wobbling action of clothes to wash the clothes. During a spin-drying mode operation of the washing machine, the wobbling device 20 is placed at the leveling position as shown in FIG. 2A, so as to be rotated along with the spin-drying tub 3 to spin-dry the clothes.

Figure 3:
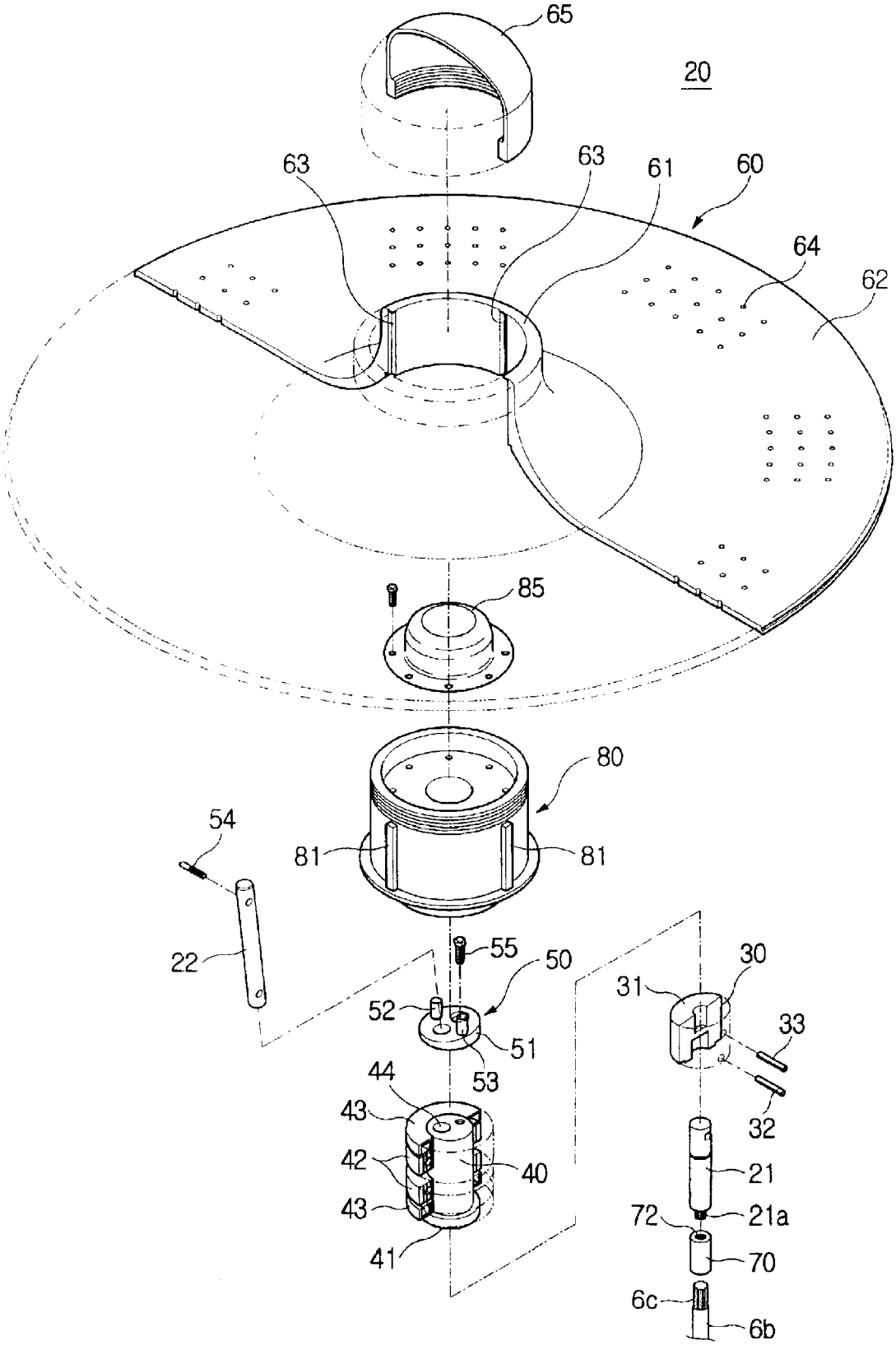
FIG. 3 is an exploded perspective view showing the construction of the wobbling device shown in FIGS. 2A and 2B.

FIG. 3 shows an exploded perspective view of the wobbling device 20 of FIGS. 2A and 2B.

As shown in FIG. 3, the wobbling device 20 comprises a vertical rotary shaft 21, which is coupled to the washing shaft 6*b* of the power transmission unit 6. An inclined rotary shaft 22 is arranged above the vertical rotary shaft 21 while being inclined relative to a vertical axis at a predetermined angle of inclination. The wobbling device 20 further comprises a first rotary unit 30 which is used to rotate the vertical and inclined rotary shafts 21 and 22 at the same time. A second rotary unit 40 rotatably receives the inclined rotary shaft 22, and is laid at its lower surface on an upper surface of the first rotary unit 30. An actuating unit 50 is arranged on an upper surface of the second rotary unit 40, and selectively shifts the wobbling device 20 between the wobbling position and the leveling position. A washboard 60 is included in the wobbling device 20. The washboard 60 is shifted between two positions, that is, the inclined position and the horizontal position, in accordance with the change in position of the wobbling device 20 between the wobbling position and the leveling position.

The vertical rotary shaft 21 is coupled at its lower end to the upper end of the washing shaft 6*b* of the power transmission unit 6 through a tubular boss 70. The vertical rotary shaft 21 is coupled at its top end to a lower portion of the first rotary unit 30 by means of a first locking pin 32, which transversely passes through both the first rotary unit 30 and the vertical rotary shaft 21. The vertical rotary shaft 21 is thus rotated along with the first rotary unit 30 when the washing shaft 6*b* is rotated.

To couple the vertical rotary shaft 21 to the washing shaft 6*b* so as to transmit torque of the washing shaft 6*b* to the vertical rotary shaft 21 without failure, both the lower end of the vertical rotary shaft 21 and the upper end of the washing shaft 6*b* are machined at their external surfaces to have uniformly spaced spline ridges 21*a* and 6*c,* respectively. The tubular boss 70 is machined at its internal surface to have corresponding spline grooves 72. Therefore, the splined lower end of the vertical rotary shaft 21 is fitted into and coupled to the splined upper end of the boss 70. In the same manner, the splined upper end of the washing shaft 6*b* is fitted into and coupled to the splined lower end of the boss 70.

Figure 4:
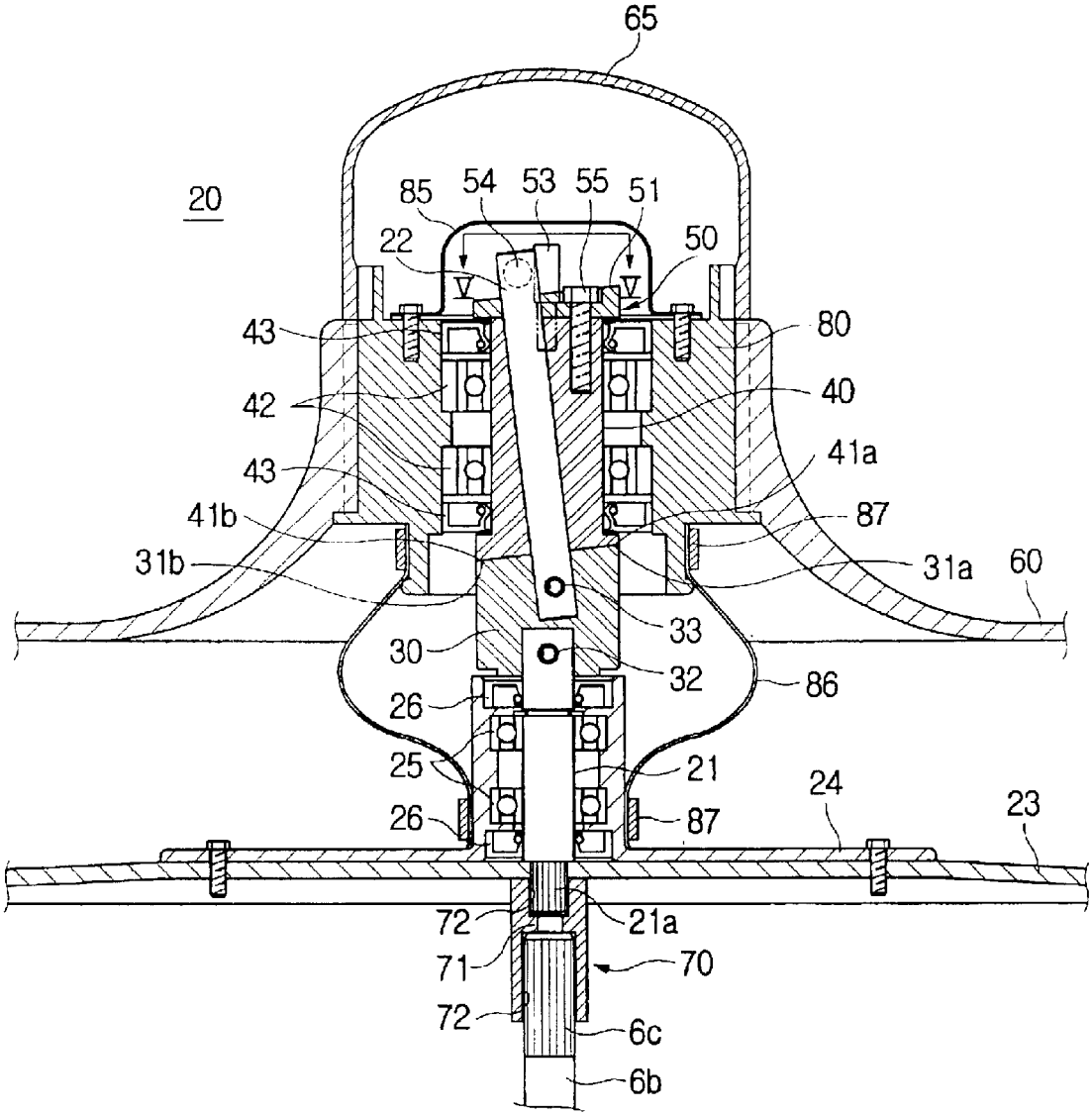
FIG. 4 is a sectional view of the wobbling device shown in FIGS. 2A and 2B in its leveling position.

As shown in FIG. 4, a step 71 is formed at an intermediate portion of the internal surface of the boss 70 so as to separate the two shafts 6*b* and 21 from each other. The vertical shaft 21 is rotatably supported by both a base 23 and a housing 24, which are installed at the bottom part 3*a* of the spin-drying tub 3 of FIG. 2A. The construction of the base 23 and the housing 24 is not shown in FIG. 3, but will be described in more detail later herein with reference to FIG. 4.

Referring back to FIG. 3, an upper surface of the first rotary unit 30 forms a first sloping surface 31, which is inclined in a radial direction of the washing shaft 6*b* at an angle of inclination. A lower surface of the second rotary unit 40, laid on the upper surface of the first rotary unit 30, forms a second sloping surface 41, which is inclined in the radial direction of the washing shaft 6*b* at the same inclination angle as that of the first sloping surface 31. The angle of inclination of the two sloping surfaces 31 and 41 determines the upward and downward wobbling angle of the washboard 60. In the present invention, the inclination angle of the two sloping surfaces 31 and 41 is, for example, about 5°~20°.

The positional change of the wobbling device 20 between the wobbling position, which causes an inclined position of the washboard 60 for performing a washing mode operation as shown in FIG. 2B, and the leveling position, which causes a horizontal position of the washboard 60 for performing a spin-drying mode operation as shown in FIG. 2A, is accomplished by varying an angular position of the second sloping surface 41 of the second rotary unit 40 relative to the first sloping surface 31 of the first rotary unit 30. Such a positional change of the wobbling device 20 will be described in more detail later herein.

The inclined rotary shaft 22 is rotatably received by the second rotary unit 40 while being inclined relative to the vertical rotary shaft 21*a* at the same inclination angle as that of the first and second sloping surfaces 31 and 41, as best seen in FIG. 4. This inclined rotary shaft 22 is coupled at its lower end to the upper portion of the first rotary unit 30 by means of a second locking pin 33, which transversely passes through both the first rotary unit 30 and the inclined rotary shaft 22. The inclined rotary shaft 22 is thus rotated along with the first rotary unit 30. That is, the first rotary unit 30 is coupled to both the vertical rotary shaft 21 at its lower end and the inclined rotary shaft 22 at its upper end. Both the first rotary unit 30 and the inclined rotary shaft 22 are thus rotated at the same time when the vertical shaft 21 is rotated.

In such a case, the inclined rotary shaft 22 passes through an inclined hole 44 of the second rotary unit 40 prior to being coupled at its lower end to the first rotary unit 30. The inclined rotary shaft 22 and the hole 44 of the second rotary unit 40 are designed so as to have a small gap formed between the shaft 22 and the hole 44 to allow the shaft 22 to be rotated in the second rotary unit 40.

A support unit 80 is fitted over the second rotary unit 40, and rotatably supports the second rotary unit 40. The support unit 80 also supports the washboard 60 so as to have the washboard 60 wobble upward and downward without being rotated during a washing mode operation. In order to rotatably support the second rotary unit 40 relative to the support unit 80, a first bearing 42 is interposed between the second rotary unit 40 and the support unit 80. Two oil seals 43 are respectively provided at upper and lower ends of the first bearing 42 to seal the first bearing 42.

The upper surface of the second rotary unit 40 is a horizontal surface as compared to its inclined lower surface 41. The actuating unit 50 is arranged on the horizontal upper surface of the second rotary unit 40.

The actuating unit 50 comprises an actuating plate 51, which is fastened to the upper surface of the second rotary unit 40 by a locking bolt 55. Two spaced pins, that is, a leveling pin 52 and a wobbling pin 53, extend upward from the upper surface of the actuating unit 50 at spaced positions to a predetermined height. An actuating pin 54 is transversely mounted to the upper portion of the inclined rotary shaft 22 so as to have the actuating pin 54 be selectively stopped by either of the two pins 52 and 53 in accordance with a rotating direction of the inclined rotary shaft 22, thus rotating the second rotary unit 40 in a desired direction. The construction and operation of the actuating unit 50 will be described in more detail later herein.

The above actuating unit 50 is covered with a cap 85 so as to be isolated from the outside of the cap 85. The cap 85 is fastened to an upper end of the support unit 80.

The washboard 60 comprises a central boss part 61, which is formed at a central portion of the washboard 60. The central boss part 61 has a cylindrical shape and is fitted over an external surface of the support unit 80. A circular blade part 62 is integrally formed around an outside edge of the central boss part 61, and seats clothes thereon during a washing operation. The blade part 62 initially extends downward and outward from the outside edge of the boss part 61 to form a diffuser shape, and secondarily extends horizontally to form a horizontal circular shape. A plurality of perforations 64 are formed at the blade part 62 to allow an upward and downward circulation of wash water through the washboard 60.

As shown in FIGS. 2A and 2B, a covering plate 68 is arranged along a circular edge of the blade part 62 of the washboard 60 and covers a gap between the spin-drying tub 3 and the edge of the blade part 62. The covering plate 68 prevents the clothes from dropping to a position under the washboard 60. The covering plate 68 is made of a material which is more flexible than the material of the washboard 60. The covering plate 68 is arranged such that a gap is less likely to be left between the covering plate 68 and the spin-drying tub 3.

Referring back to FIG. 3, to fasten the washboard 60 to the support unit 80, a plurality of vertical ribs 81 are regularly formed on an external surface of the support unit 80. A plurality of vertical grooves 63 are regularly formed on an internal surface of the central boss part 61 of the washboard 60, and engage with the vertical ribs 81 of the support unit 80, respectively.

A covering cap 65 covers the upper end of the support unit 80 at the top of the central boss part 61 of the washboard 60, thus isolating the support unit 80 from the clothes seated on the washboard 60 during the washing operation. The covering cap 65 is fastened to the support unit 80, for example, through a screw type engagement.

Figure 5:
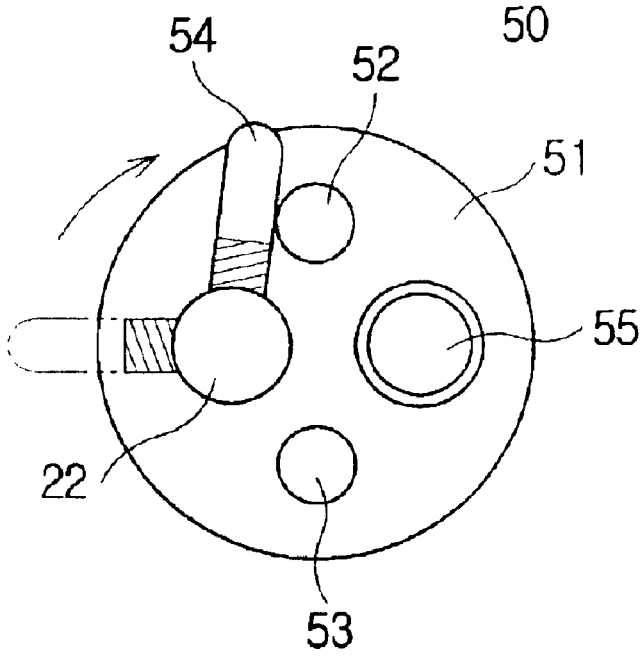
FIG. 5 is a sectional view of the wobbling device taken along the line V—V of FIG. 4.

FIG. 4 shows a sectional view of the wobbling device 20 in the leveling position. FIG. 5 shows a sectional view taken along the line V—V of FIG. 4 illustrating an operation of the actuating unit 50 where the wobbling device 20 is placed in the leveling position.

As shown in FIGS. 4 and 5, the vertical rotary shaft 21 is rotatably held by a second bearing 25 inside the housing 24. Two oil seals 26 are respectively provided at upper and lower ends of the second bearing 25 to seal the second bearing 25 and prevent an undesired infiltration of external impurities into the second bearing 25. The housing 24, for example, is bolted to the upper surface of the base 23. The base 23, having a disc shape with several holes, is also bolted to an internal surface of the bottom part 3*a* of the spin-drying tub 3 as shown in FIGS. 2A and 2B. The lower end of the vertical rotary shaft 21 and the upper end of the washing shaft 6*b* are coupled to the tubular boss 70 through a spline coupling method, and the vertical rotary shaft 21 is rotated by the torque of the washing shaft 6*b*.

The inclined rotary shaft 22 passes through the inclined hole 44 of the second rotary unit 40 at a predetermined angle of inclination, so as to have the upper and lower ends of the inclined rotary shaft 22 project from both ends of the second rotary unit 40. In such a case, a small gap is formed between the inclined rotary shaft 22 and the hole 44 of the second rotary unit 40 so as to allow the shaft 22 to be rotated relative to the second rotary unit 40.

The upper end of the vertical rotary shaft 21 and the lower end of the inclined rotary shaft 22 are coupled to the first rotary unit 30 by the two locking pins 32 and 33, respectively. Therefore, the two shafts 21 and 22 are rotated along with the first rotary unit 30.

The second rotary unit 40 is rotatably held in the support unit 80 by the first bearing 42 having the oil seals 43. The washboard 60 is assembled to an external surface of the support unit 80.

The actuating plate 51 of the actuating unit 50 is fastened to the upper surface of the second rotary unit 40 by the locking bolt 55. The two spaced pins, that is, the leveling pin 52 and the wobbling pin 53, extend upward from the upper surface of the actuating unit 50 at two positions, which are angularly spaced apart from each other by, for example, an angle of about 180° as shown in FIG. 5. The actuating pin 54 is transversely mounted to the upper portion of the inclined rotary shaft 22. The actuating pin 54 of the inclined rotary shaft 22 is selectively stopped by either of the two pins 52 and 53 in accordance with a rotating direction of the inclined rotary shaft 22, thus rotating the second rotary unit 40 assembled with the actuating plate 51.

When the actuating pin 54 of the inclined rotary shaft 22 is rotated from a position shown by the two-dot chain line of FIG. 5 to another position shown by the solid line in accordance with a clockwise rotating action of the inclined rotary shaft 22, the actuating pin 54 is brought into contact with the leveling pin 52. In such a case, an upper part 31*a* of the first sloping surface 31 of the first rotary unit 30 meets an upper part 41*a* of the second sloping surface 41 of the second rotary unit 40 as shown in FIG. 4. In addition, a lower part 31*b* of the first sloping surface 31 of the first rotary unit 30 meets the lower part 41*b* of the second sloping surface 41 of the second rotary unit 40. Therefore, the upper surfaces of both the second rotary unit 40 and the support unit 80 are horizontally positioned. This creates a horizontal positioning of the washboard 60, which is assembled with the support unit 80. That is, the wobbling device 20 of this invention is placed in its leveling position for performing a spin-drying mode operation.

The second rotary unit 40 is rotatably set in the support unit 80 by the first bearing 42. Thus, it is necessary to stably hold the support unit 80 such that the support unit 80 is not rotated by a rotating action of the second rotary unit 40. To accomplish the above and other objects, a flexible holder 86 is installed at a position between the housing 24 and the support unit 80. The flexible holder 86 surrounds the first rotary unit 30 and a central portion of the housing 24. The flexible holder 86 is designed so as to be flexible in a vertical direction in response to a wobbling action of the washboard 60. Upper and lower ends of the flexible holder 86 are fastened to the support unit 80 and the housing 24 by, for example, fastening wires 87, respectively.

Figure 6:
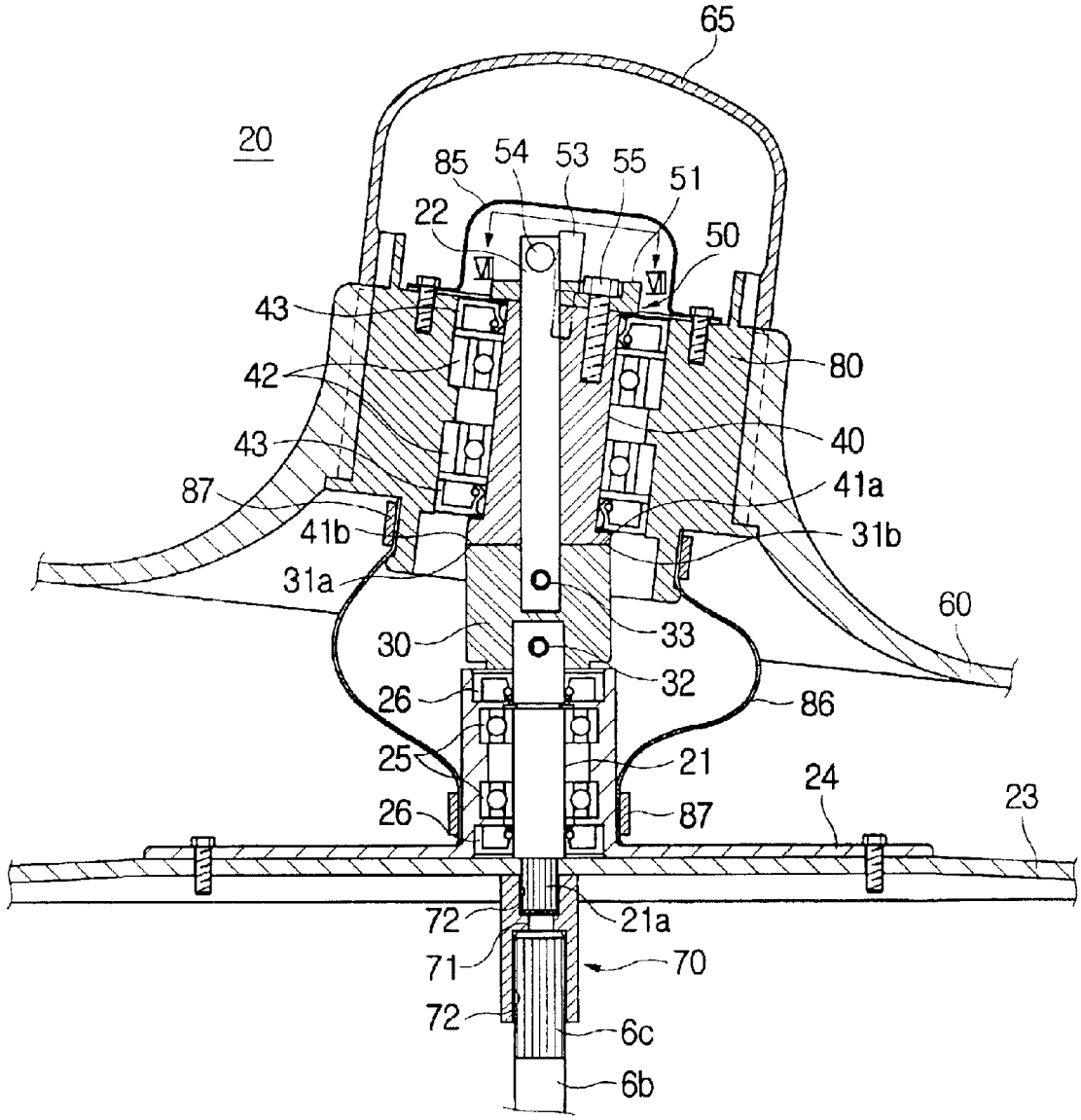
FIG. 6 is a sectional view of the wobbling device shown in FIGS. 2A and 2B in its wobbling position.
Figure 7:
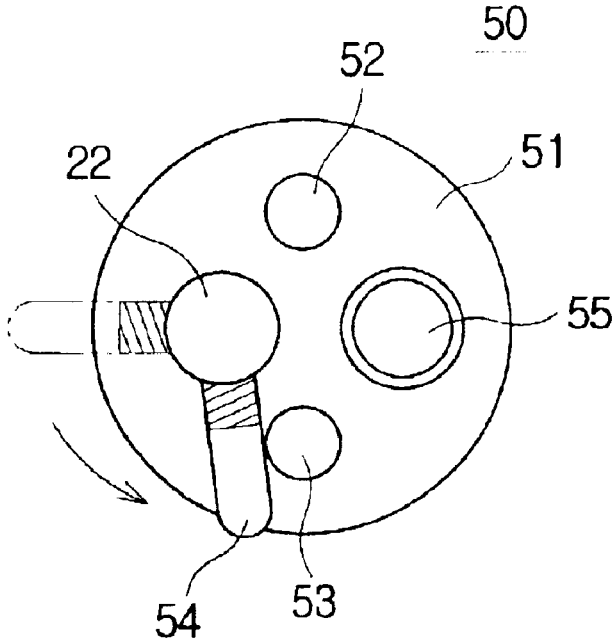
FIG. 7 is a sectional view of the wobbling device taken along the line VII—VII of FIG. 6.

FIGS. 6 and 7 show sectional views corresponding to FIGS. 4 and 5, respectively, where the wobbling device 20 is converted from the leveling position to the wobbling position. That is, the washboard 60 wobbles upward and downward to perform a washing mode operation. FIG. 7 shows a sectional view of the wobbling device 20 taken along the line VII—VII of FIG. 6 to illustrate an operation of the actuating unit 50 when the wobbling device 20 is placed in the wobbling position.

When the actuating pin 54 of the inclined rotary shaft 22 is rotated from the position shown by the two-dot chain line of FIG. 7 to another position shown by the solid line in accordance with a counterclockwise rotating action of the inclined rotary shaft 22, for performing a washing mode operation, the actuating pin 54 is brought into contact with the wobbling pin 53. In such a case, the upper part 31*a* of the first sloping surface 31 of the first rotary unit 30 meets the lower part 41*b* of the second sloping surface 41 of the second rotary unit 40 as shown in FIG. 6. In addition, the lower part 31*b* of the first sloping surface 31 of the first rotary unit 30 meets the upper part 41*a* of the second sloping surface 41 of the second rotary unit 40. Therefore, the two sloping surfaces 31 and 41 are positioned almost horizontally, while the upper surfaces of both the second rotary unit 40 and the support unit 80 are inclinedly positioned. This creates an inclined position of the washboard 60, which is assembled with the external surface of the support unit 80. When both the inclined rotary shaft 22 and the second rotary unit 40 in the above state are rotated by the torque of the washing shaft 6*b*, the washboard 60 wobbles upward and downward at a predetermined amplitude in response to a rotating speed of the inclined rotary shaft 22.

An operational effect of the vertical shaft type washing machine of the present invention having the wobbling device 20 will be described herein below.

When the washing machine is turned on after placing the clothes into the spin-drying tub 3, water is primarily fed into the washing tub 2. At the same time, the drive motor 5 is rotated to generate a rotating force, which is transmitted to the wobbling device 20 through the power transmission unit 6, thus actuating the wobbling device 20.

That is, while the water is fed into the washing tub 2, both the washing shaft 6*b* and the vertical rotary shaft 21 are rotated, for example, clockwise by the drive motor 5 at a low speed to rotate the spin-drying tub 3 at a low speed, and cause the clothes to be wetted by water. The inclined rotary shaft 22, coupled to the vertical rotary shaft 21 through the first rotary unit 30, is also rotated along with the two shafts 6*b* and 21. The inclined rotary shaft 22 is thus rotated clockwise at an angle of about 90° from the position shown by the two-dot chain line of FIG. 5, and so the actuating pin 54 of the inclined rotary shaft 22 is brought into contact with the leveling pin 52. In such a case, the upper part 31*a* of the first sloping surface 31 of the first rotary unit 30 meets the upper part 41*a* of the second sloping surface 41 of the second rotary unit 40 as shown in FIG. 4. Therefore, the upper surfaces of both the second rotary unit 40 and the support unit 80 are horizontally positioned, thus creating a horizontal positioning of the washboard 60. That is, the wobbling device 20 of this invention is placed in its leveling position.

When the inclined rotary shaft 22 at such a leveling position is further rotated clockwise, the upper surface of the second rotary unit 40 is rotated along with the inclined rotary shaft 22 while maintaining the horizontal position of its upper surface. Both the support unit 80 and the washboard 60 maintain their horizontal positions without performing any wobbling action. In such a case, the spin-drying tub 3 is rotated at a low speed by the spin-drying shaft 6*a*, thus rotating the clothes laid on the washboard 60 and allowing the clothes to be uniformly wetted by the water fed into the washing tub 2.

When the washing shaft 6*b* in the above state is rotated counterclockwise, with the spin-drying shaft 6*a* stopped, the vertical rotary shaft 21, the first rotary unit 30 and the inclined rotary shaft 22 are simultaneously rotated counterclockwise. Therefore, the actuating pin 54 of the inclined rotary shaft 22 is rotated counterclockwise from the position of FIG. 5 at an angle of about 180°, thus being brought into contact with the leveling pin 52 as shown in FIG. 7

When the actuating unit 50 is shifted from the position of FIG. 5 to the position of FIG. 7, the upper part 31*a* of the first sloping surface 31 of the first rotary unit 30 meets the lower part 41*b* of the second sloping surface 41 of the second rotary unit 40 as shown in FIG. 6. Therefore, the upper surfaces of both the second rotary unit 40 and the support unit 80 are inclinedly positioned, thus creating an inclined position of the washboard 60. That is, the wobbling device 20 of this invention is placed in its wobbling position.

When the inclined rotary shaft 22 at such a wobbling position is further rotated counterclockwise, the second rotary unit 40 is rotated along with the inclined rotary shaft 22. In such a case, both the support unit 80 and the washboard 60 wobble upward and downward without being rotated. When both the support unit 80 and the washboard 60 wobble upward and downward without being rotated as described above, the washboard 60 imparts vertical impact energy to the clothes, and generates vertically directional water currents, thus washing the clothes. In such a case, the impact energy applied to both the clothes and the wash water is increased in proportion to the rotating speed of the washing shaft 6*b*. Therefore, it is possible to accomplish a desired washing effect by appropriately controlling both the amount of wash water and the rotating speed of the washing shaft in accordance with the amount of clothes to be washed.

When the washing mode operation is completed, after a predetermined length of time from a start of the washing operation, the wash water is drained from the washing tub 2 through the drain hose 8 prior to starting a rinsing mode operation which removes detergent from the clothes. After the rinsing mode operation, the spin-drying tub 3 is rotated at a high speed by the spin-drying shaft 6*a* to spin-dry the clothes. In such a case, the actuating pin 54 of the actuating unit 50 is rotated clockwise from the position of FIG. 7 to the position of FIG. 5. The wobbling device 20 is thus converted to its leveling position where the washboard 60 is positioned horizontally. In such a case, the washboard 60 is rotated along with the spin-drying shaft 6*a* without performing any wobbling action, and a desired spin-drying mode operation is performed.

In the washing mode operation, clothes are washed by the wobbling action of the washboard 60. That is, during the wobbling action of the washboard 60, the clothes are imparted with both mechanical impact energy acting in a vertical direction, and hydraulic impact energy caused by the wash water flowing through the perforations 64 of the washboard 60. Thus, it is possible to accomplish a desired washing effect with a small amount of water contained in the washing tub 2 where the clothes laid on the washboard 60 are merely wetted by the water. Accordingly, the washing machine of the present invention reduces the amount of water required in a washing operation, as compared to a conventional washing machine having a pulsator.

As described above, the wobbling device 20 includes the vertical rotary shaft 21, which is arranged between the washing shaft 6*b* and the first rotary unit 30. However, it is understood that the wobbling device 20 of the present invention may be fabricated without the vertical rotary shaft 21. That is, the washing shaft 6*b* may be directly coupled to the first rotary unit 30 in place of being indirectly coupled to the first rotary unit 30 through such a vertical rotary shaft 21, without affecting the functionality of the present invention.

In addition, the leveling pin 52 and the wobbling pin 53 are provided at the upper surface the actuating unit 50, which includes the actuating plate 51 assembled to the upper surface of the second rotary unit 40. However, it is understood that the positions of the two pins 52 and 53 may be changed without affecting the functionality of the present invention. That is, the two pins 52 and 53 may be directly formed at the upper surface of the second rotary unit 40 in place of being formed at the actuating plate 51.

Furthermore, the actuating pin 54 is transversely installed at the upper portion of the inclined rotary shaft 22. However, it is understood that the position of the actuating pin 54 may be changed. That is, the actuating pin 54 may be provided on any one of the first rotary unit 30, the vertical rotary shaft 21 and the washing shaft 6*b*. In such a case, both the leveling pin 52 and the wobbling pin 53 may be placed at appropriate positions of the second rotary unit 40 in accordance with the position of the actuating pin 54.

As described above, the present invention provides a vertical shaft type washing machine having a wobbling device which causes an upward and downward wobbling action of a washboard without rotating the washboard during a washing mode operation. Therefore, the washing machine does not cause clothes to be twisted and tangled up during the washing operation, thereby preventing abrasion and damage to the clothes during the washing operation. In addition, the washing machine is convenient to use as a user need not untwist and untangle the clothes after the washing operation.

In the washing machine of this invention, a washing shaft is rotated in one direction during the washing operation. Therefore, it is possible to reduce the consumption of electric power of a drive motor. In addition, the expected life span of the drive motor is increased.

Additionally, it is possible to accomplish a desired washing effect with a small amount of water (a low water level) in a washing tub, where the clothes laid on a washboard are merely wetted by the water. The desired washing effect is, in part, effectively accomplished by an upward and downward wobbling action of the washboard. Thus, the washing machine of the present invention requires less water and detergent to carry out a washing operation than the conventional washing machine. Accordingly, the washing machine of the present invention also provides a marketing advantage in light of the recent trend toward saving water and limiting the use of materials that pollute the environment.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A washing machine comprising:

a washing tub to contain wash water therein;

a spin-drying tub rotatably set in the washing tub to contain clothes therein;

a spin-drying shaft which rotates the spin-drying tub;

a washing shaft which axially passes through and projects from a top end of the spin-drying shaft; and a wobbling device coupled to a projected end of the washing shaft, which causes the clothes to wobble upward and downward to wash the clothes, wherein the wobbling device comprises:

an inclined rotary shaft arranged in an axial direction of the washing shaft at an angle of inclination, a first rotary unit which rotates in response to torque of the washing shaft, having a first sloping surface inclined in a radial direction of the washing shaft at a set angle of inclination, a second rotary unit arranged to be rotated relative to the first rotary unit, having a second sloping surface which corresponds to the first sloping surface of the first rotary unit, and a hole axially formed in the second rotary unit and rotatably receives the inclined rotary shaft therein, an actuating pin installed to and rotates along with one of the washing shaft, the first rotary unit and the inclined rotary shaft, a wobbling pin and a leveling pin provided on the second rotary unit at spaced positions, and a washboard arranged at an interior lower portion of the spin-drying tub, which wobbles in response to rotating of the actuating pin in contact with the wobbling pin and is leveled in response to rotating of the actuating pin in contact with the leveling pin.

2. The washing machine according to claim 1, wherein:

the inclined rotary shaft passes through the hole of the second rotary unit so as to be projected at an upper end thereof from an upper end of the second rotary unit, the actuating pin is transversely mounted to the upper end of the inclined rotary shaft, and the leveling and wobbling pins are arranged on an upper surface of the second rotary unit at positions angularly spaced apart from each other at an angle of about 180°.

3. The washing machine according to claim 2, wherein:

the first inclined surface is formed at an upper end of the first rotary unit, the second inclined surface is formed at a lower end of the second rotary unit, the upper surface of the secondary rotary unit is leveled to have the washboard in a leveled position in response to the actuating pin being rotated in a first direction while coming into contact with the leveling pin, wherein an upper part of the first sloping surface meets an upper part of the second sloping surface, and the upper surface of the secondary rotary unit is inclined to have the washboard in a wobbling position in response to the actuating pin being rotated in a second direction while coming into contact with the wobbling pin, wherein a lower part of the first sloping surface meets the upper part of the second sloping surface.

4. The washing machine according to claim 3, wherein the set angle of inclination is in a range of about 5°~20°.

5. The washing machine according to claim 1, further comprising a support unit which is installed between the second rotary unit and the washboard, wherein:

the support unit is level at an upper surface thereof with an upper surface of the second rotary unit, and includes a bearing which rotatably receives the second rotary unit, and the washboard is supported by the support unit so as to have the washboard wobble regardless of a rotating action of the second rotary unit.

6. The washing machine according to claim 5, wherein:

the support unit further includes vertical ribs which are formed on an external surface of the support unit, and the washboard includes vertical grooves which are formed on an internal surface of the washboard, wherein the vertical grooves engage with the vertical ribs to secure the washboard to the support unit.

7. The washing machine according to claim 5, wherein the support unit further includes a cap which is provided at an upper end of the support unit, and covers the second rotary unit.

8. The washing machine according to claim 5, wherein the washboard includes a covering cap which is provided at an upper end of the washboard, and covers an upper end of the support unit.

9. The washing machine according to claim 5, further comprising a vertical rotary shaft which is arranged between the washing shaft and the first rotary unit, and transmits the torque of the washing shaft to the first rotary unit, wherein the vertical rotary shaft is coupled at an upper end thereof to a lower end of the first rotary unit, and coupled at a lower end thereof to an upper end of the washing shaft.

10. The washing machine according to claim 9, further comprising a tubular boss which is installed between the vertical rotary shaft and the washing shaft, and has spline grooves at an internal surface thereof, wherein:

each of the lower end of the vertical rotary shaft and the upper end of the washing shaft is provided with spline ridges, and the spline grooves engage with the spline ridges of both the vertical rotary shaft and the washing shaft to couple the vertical rotary shaft to the washing shaft and transmit the torque of the washing shaft to the vertical rotary shaft.

11. The washing machine according to claim 9, further comprising a housing which is provided at a bottom of the spin-drying tub having a bearing which rotatably supports the vertical rotary shaft.

12. The washing machine according to claim 11, further comprising a holder which is arranged between the support unit and the housing, and holds the support unit so as not to rotate the support unit regardless of a rotating action of the second rotary unit.

13. The washing machine according to claim 12, wherein a portion of the holder is made of an elastic material so as to allow the holder to be flexible in a vertical direction in response to wobbling of the washboard.

14. The washing machine according to claim 9, wherein:

the vertical rotary shaft and the inclined rotary shaft are coupled to the first rotary unit by locking pins, and the locking pins transversely pass through the vertical rotary shaft and the inclined rotary shaft prior to being held by the first rotary unit.

15. The washing machine according to claim 9, wherein the actuating pin is installed to and rotates along with the vertical rotary shaft.

16. The washing machine according to claim 5, wherein the washboard comprises:

a central boss part which is formed at a central portion of the washboard and fitted over the support unit;

a circular blade part which is integrally formed around an outer edge of the central boss part and seats the clothes thereon; and perforations formed at the blade part which allows circulation of the wash water.

17. The washing machine according to claim 1, further comprising a covering plate which is arranged along an edge of the washboard and covers a gap between the spin-drying tub and the edge of the washboard, so as to prevent the clothes from dropping to a position under the washboard.

18. The washing machine according to claim 1, wherein the spin-drying tub includes perforations formed at a sidewall of the spin-drying tub, which allows circulation of the wash water.

19. The washing machine according to claim 1, further comprising:

a drive motor which generates a rotating force; and a power transmission unit which transmits the rotating force from the drive motor to the spin-drying and washing shafts.

20. The washing machine according to claim 1, wherein the set angle of inclination determines a wobbling angle of the washboard.

21. The washing machine according to claim 1, wherein the wobbling and leveling pins selectively stop the actuating pin according to a rotating direction of the inclined rotary shaft so as to rotate the secondary rotary unit in a desired direction.

22. A wobbling device of a washing machines, the washing machine including a spin-drying tub rotatably set in a tub to contain clothes, a drive motor to provide a rotating force, and a rotating shaft to transfer the rotating force of the drive motor to the wobbling device, the wobbling device comprising:

at a bottom portion of the spin-drying tub;

a first rotary unit to rotate in response to torque of the rotating shaft, having a first sloping surface inclined in a radial direction of the rotating shaft;

a second rotary unit to rotate relative to the first rotary unit, having a second sloping surface that corresponds to the first sloping surface and a hole axially formed in the second rotary unit at a set angle of inclination;

an inclined rotary shaft, rotatably arranged in the hole, to project from an upper end surface of the second rotary unit;

an actuating pin which is installed to and rotates along with one of the inclined rotary shaft, the rotating shaft and the first rotary unit; and wobbling and leveling pins provided on the second rotary unit at positions corresponding to rotating directions of the actuating pin, such that the washboard wobbles in response to a rotation of the actuating pin when the actuating pin contacts the wobbling pin, and such that the washboard is level when the actuating pin contacts the leveling pin, wherein the wobbling device levels the washboard and rotates the spin drying tub in response to the rotating shaft being rotated in one direction, and wobbles the washboard upward and downward to wash the clothes in response to the rotating shaft being rotated in another direction.

23. The washing machine according to claim 22, wherein the washboard is provided with perforations which circulate the wash water to provide hydraulic impact energy to the clothes.

24. The washing machine according to claim 22, wherein:

the first inclined surface is formed at an upper end surface of the first rotary unit, the second inclined surface is formed at a lower end surface of the second rotary unit, the upper end surface of the secondary rotary unit is leveled to have the washboard in a leveled position in response to the actuating pin being rotated in a first direction while coming into contact with the leveling pin, wherein an upper part of the first sloping surface meets a lower part of the second sloping surface, and the upper end surface of the secondary rotary unit is inclined to have the washboard in a wobbling position in response to the actuating pin being rotated in a second direction while coming into contact with the wobbling pin, wherein a lower part of the first sloping surface meets the lower part of the second sloping surface.

25. The washing machine according to claim 22, wherein the wobbling device causes a up and down wobbling action of the washboard to provide mechanical impact energy to the clothes without concentrically rotating the washboard.

26. The washing machine according to claim 25, wherein the washing machine is a vertical shaft type washing machine.

27. The washing machine according to claim 25, wherein:

the clothes are moved vertically in response to the up and down wobbling action of the washboard, and the washboard wobbles upward and downward in a set angle of inclination.

28. A wobbling device of a washing machine, the washing machine including a spin-drying tub rotatably set in a tub to contain clothes, a drive motor to provide a rotating force, and a rotating shaft to tansfer the rotating force of the drive motor to the wobbling device, the wobbling device comprising:

a washboard are to be set at a bottom portion of the spin-drying tub;

first rotary unit to rotate in response to torque of the rotating shaft, having a first sloping surface inclined in a radial direction of the rotating shaft at an angle of inclination;

a second rotary unit to rotate relative to the first rotary unit, having a second sloping surface that corresponds to the first sloping surface and a hole axially formed in the second rotary unit at a set angle of inclination;

an inclined rotary shaft, rotatably arranged in the hole, to project from an upper end surface of the second rotary unit;

an actuating pin which is installed to and rotates along with one of the inclined rotary shaft, the rotating shaft and the first rotary unit; and wobbling and leveling pins provided on the second rotary unit at positions corresponding to rotating directions of the actuating pin, such that the washboard wobbles in response to a rotation of the actuating pin when the actuating pin contacts the wobbling pin, and such that the washboard is level when the actuating pin contacts the leveling pin, wherein the wobbling device levels the washboard and rotates the spin drying tub in response to the rotating shaft being rotated in one direction, and moves the washboard upward and downward to wash the clothes in response to the rotating shaft being rotated in another direction.

29. A wobbling device of a washing machine, including a spin-drying tub rotatably set in a tub to contain clothes, a drive motor to provide a rotating force, and a rotating shaft to transfer the rotating force of the drive motor to the wobbling device, the wobbling device comprising:

a washboard on which clothes are to be set at a bottom portion of the spin-drying tub;

a first rotary unit to rotate in response to torque of the rotating shaft, having a first sloping surface inclined in a radial direction of the rotating shaft;

a second rotary unit to rotate relative to the first rotary unit, having a second sloping surface that corresponds to the first sloping surface and a hole axially formed in the second rotary unit at a set angle of inclination;

an inclined rotary shaft, rotatably arranged in the hole, to project from an upper end surface of the second rotary unit;

an actuating pin which is installed to and rotates along with one of the inclined rotary shaft, the rotating shaft and the first rotary unit; and wobbling and leveling pins provided on the second rotary unit at positions corresponding to rotating directions of the actuating pin, such that the washboard wobbles in response to a rotation of the actuating pin when the actuating pin contacts the wobbling pin in accordance with the rotating shaft rotating in a first direction, and such that the washboard is level when the actuating pin contacts the leveling pin in accordance with the rotating shaft rotating in a second direction, wherein when the washboard wobbles, clothes set thereon are moved in vertical directions.

30. A wobbling device of a washing machine, the washing machine including a spin-drying tub rotatably set in a tub to contain clothes, a drive motor to provide a rotating force, and a rotating shaft to transfer the rotating force of the drive motor to the wobbling device, the wobbling device comprising:

a washboard at a bottom portion of the spin-drying tub;

a first rotary unit to rotate in response to torque of the rotating shaft, having a first sloping surface inclined in a radial direction of the rotating shaft;

a second rotary unit to rotate relative to the first rotary unit, having a second sloping surface that corresponds to the first sloping surface and a hole axially formed in the second rotary unit at a set angle of inclination;

an inclined rotary shaft, rotatably arranged in the hole, to project from an upper end surface of the second rotary unit;

an actuating pin which is installed to and rotates along with one of the inclined rotary shaft, the rotating shaft and the first rotary unit; and wobbling and leveling pins provided on the second rotary unit at positions corresponding to rotating directions of the actuating pin, such that the washboard wobbles in response to a rotation of the actuating pin when the actuating pin contacts the wobbling pin in accordance with the rotating shaft rotating in a first direction, and such that the washboard is level when the actuating pin contacts the leveling pin in accordance with the rotating shaft rotating in a second direction.

31. An apparatus for producing a wobbling motion of a washboard in a washing machine, comprising:

a first rotary unit having a first longitudinal axis, said first rotary unit including a first distal end and a second distal end disposed on respective opposite ends of said first longitudinal axis, said second distal end receiving a rotational force to thereby rotate said first rotary unit about said first longitudinal axis, said first distal end having a first inclined surface that forms a sloped plane, said sloped plane forming an incline angle with respect to an imaginary reference plane perpendicular to said first longitudinal axis;

a second rotary unit having a second longitudinal axis, a third distal end and a fourth distal end, said third and fourth distal ends being disposed on respective opposite ends of said second longitudinal axis, said third distal end having a second inclined surface, said second inclined surface maintaining an opposing contact with said first inclined surface;

a rotary shaft protruding outwardly from said first inclined surface, said rotary shaft being fixedly coupled to said first rotary unit, and moving together therewith when said first rotary unit is rotated, said rotary shaft penetrating said second inclined surface, and extending into said second rotary unit from said third distal end towards said fourth distal end, said rotary shaft being having a free movement relative to, and independent of, said second rotary unit; and an actuating unit, having at least a portion thereof coupled to said rotary shaft, arranged to cause said rotary shaft and second rotary unit to move together as one unit, by limiting said free movement of said rotary shaft relative to said secondary rotary unit when said first inclined surface and said second inclined surface oppose each other in a first orientation to form a wobble angle between said first longitudinal axis and said second longitudinal axis, so as to cause said washboard disposed on said second rotary unit to be tilted with respect to said first longitudinal axis, to thereby produce said wobbling motion of said washboard.

32. The apparatus for producing said wobbling motion according to claim 31, wherein:

said actuating unit limits said free movement of said rotary shaft relative to said secondary rotary unit when said first inclined surface and said second inclined surface oppose each other in a second orientation such that said first longitudinal axis and said second longitudinal axis align in a substantially same direction so as to cause said washboard disposed on said second rotary unit to be substantially leveled with respect to said imaginary reference plane.

33. The apparatus for producing said wobbling motion according to claim 32, wherein:

said rotary shaft extends through said second rotary unit to have a portion of said rotary shaft to project outwardly from said fourth distal end; and wherein said actuating unit comprises;

an actuating pin transversely mounted on said portion of said rotary shaft projecting from said fourth distal end;

a wobbling pin disposed on, and protruding outwardly from, a first position on a surface of said fourth distal end; and a leveling pin disposed on, and protruding outwardly from, a second position on said surface of said fourth distal end;

wherein said first inclined surface and said second inclined surface oppose each other in said first orientation when said actuating pin makes abutting contact with said wobbling pin, and wherein said first inclined surface and said second inclined surface oppose each other in said second orientation when said actuating pin makes abutting contact with said leveling pin.

34. The apparatus for producing said wobbling motion according to claim 33, further comprising:

a spin-drying tub housed in said washing machine; and a spin-drying shaft, coupled to said spin-drying tub, receiving said rotational force to rotate said spin-drying shaft when said first inclined surface and said second inclined surface oppose each other in said second orientation.

35. The apparatus for producing said wobbling motion according to claim 34, further comprising:

a support unit fixedly mounted to said spin-drying tub, said support unit having a central passage to receive said first rotary unit therein, said central passage and said first rotary unit forming a gap therebetween to allow said support unit and said first rotary unit to rotate freely and independently with respect to each other.

36. The apparatus for producing said wobbling motion according to claim 35, further comprising:

a bearing disposed between said central passage and said first rotary unit.

37. The apparatus for producing said wobbling motion according to claim 34, wherein said incline angle is equal to said wobble angle.

38. The apparatus for producing said wobbling motion according to claim 33, wherein:

said wobbling pin and said leveling pin are angularly spaced apart from each other on said surface of said fourth distal end by an approximate angle of 180 degrees.

39. The apparatus for producing said wobbling motion according to claim 31, further comprising:

a support unit disposed between said second rotary unit and said washboard, said washboard being detachably mounted on said support unit, said support unit having a central passage and said second rotary unit forming a gap therebetween to allow said support unit and said second rotary unit to rotate freely and independently with respect to each other.

40. The apparatus for producing said wobbling motion according to claim 39, further comprising:

a bearing disposed between said central passage and said second rotary unit.

41. The apparatus for producing said wobbling motion according to claim 39, further comprising:

a plurality of ribs formed on an external surface of said support unit; and a plurality of grooves formed on said washboard, said plurality of grooves engaging with respective ones of said plurality of ribs in order to detachably mount said washboard on said support unit.

42. The apparatus for producing said wobbling motion according to claim 31, wherein said wobble angle is between 5 degrees and 20 degrees.

* * * * *

UNITED STATES PATENT AND TRADEMARK OFFICE

CERTIFICATE OF CORRECTION

PATENT NO. : 6,986,271 B2
APPLICATION NO. : 10/197336
DATED : January 17, 2006
INVENTOR(S) : Hyung-Kyoon Kim et al.

It is certified that error appears in the above-identified patent and that said Letters Patent is hereby corrected as shown below:

On Title page

Item (56) References Cited, U.S. Patent Documents, column 1, line 2, change "Clark" to --Kendall--

Item (56) References Cited, Other Publications, change "Kim Hyung-Kyoon" to --Hyung-Kyoon Kim--

Item (56) References Cited, Other Publications, change " Pyo Sang-Yeon" to --Sang-Yeon Pyo--

Item (56) References Cited, Other Publications, change "Kim Hyun-Sook" to --Hyun-Sook Kim--

Column 14, line 33, change "machines" to --machine--

Column 14, line 38, after "comprising:" insert --a washboard--

Column 14, line 60, change "spin drying" to --spin-drying--

Column 15, line 20, after "causes", change "a" to --an--

Column 15, line 34, change "tansfer" to --transfer--

Column 15, line 39, insert --a-- before "first"

Column 15, line 61, change "spin drying" to --spin-drying--

UNITED STATES PATENT AND TRADEMARK OFFICE

CERTIFICATE OF CORRECTION

PATENT NO. : 6,986,271 B2
APPLICATION NO. : 10/197336
DATED : January 17, 2006
INVENTOR(S) : Hyung-Kyoon Kim et al.

It is certified that error appears in the above-identified patent and that said Letters Patent is hereby corrected as shown below:

Column 17, line 50, after “comprises” change, “;” to --:--

Signed and Sealed this

Twelfth Day of September, 2006

JON W. DUDAS
*Director of the United States Patent and Trademark Office*